US005694712A

United States Patent [19]

Plonka

[11] Patent Number: 5,694,712

[45] Date of Patent: Dec. 9, 1997

[54] DOVETAIL SCOPE MOUNT SYSTEM

[75] Inventor: Skip M. Plonka, 7 S 065 Suffield Ct., Unit #106, Westmont, Ill. 60559

[73] Assignee: Skip M. Plonka, Westmont, Ill.

[21] Appl. No.: 553,862

[22] Filed: Nov. 6, 1995

[51] Int. Cl.[6] ..... F41G 1/387

[52] U.S. Cl. ..... 42/101; 33/245

[58] Field of Search ..... 42/101; 33/245, 33/246, 247, 248, 249, 250

[56] References Cited

U.S. PATENT DOCUMENTS

| | | | |
|---|---|---|---|
| 2,079,266 | 5/1937 | Vaver | 33/250 |
| 2,306,972 | 12/1942 | Meisel | 33/250 |
| 3,992,783 | 11/1976 | Dunlap et al. | 33/250 |
| 4,328,624 | 5/1982 | Ross | 33/245 |
| 4,383,371 | 5/1983 | Coffey | 33/245 |
| 4,845,871 | 7/1989 | Swan | 42/101 |
| 4,873,779 | 10/1989 | Ellison et al. | 42/101 |
| 4,890,407 | 1/1990 | Nichols | 33/245 |
| 5,033,219 | 7/1991 | Johnson et al. | 42/103 |
| 5,046,277 | 9/1991 | Sanders | 42/101 |
| 5,142,806 | 9/1992 | Swan | 42/101 |
| 5,606,818 | 3/1997 | Hardee | 42/101 |

FOREIGN PATENT DOCUMENTS

| | | | |
|---|---|---|---|
| 9207230 | 4/1992 | WIPO | 33/245 |

*Primary Examiner*—Stephen M. Johnson

[57] ABSTRACT

A universal mounting system for mounting a scope fitted with Weaver style rings to a standard ⅜" or other suitably grooved receiver typically associated with a small caliber firearm. A first embodiment of the invention includes an adapter plate configured to be secured to a base of a tipoff or dovetail style scope mounting system. The adapter plate of the embodiment also includes a central aperture and clamping members provided to secure a Weaver style base to the adapter plate through the use of fasteners. Another embodiment of the present invention includes a base configured with a grooved bottom portion for engaging a dovetail grooved receiver of a firearm. A top portion is rigidly or integrally secured to the bottom portion and exhibits the characteristics of a Weaver style base.

1 Claim, 2 Drawing Sheets

DOVETAIL SCOPE MOUNT SYSTEM

BACKGROUND OF THE INVENTION

1. Field of the Invention

The present invention relates generally to scope mounts and scope mount bases typically associated with firearms capable of receiving a shooting scope, but more particularly, to grooved receivers of certain firearms, generally of small caliber, and the scope mounting hardware used to attach a scope as well as "Weaver" style scope mount bases.

2. Description of the Related Art

Grooved receivers are commonly associated with small caliber firearms such as a 22 caliber pistol, rifle and the like. The grooved receiver typically includes a male component of a dovetail cooperating connection milled into the top portion of the receiver, or in the alternative is associated with a separate piece of receiver attachment structure (hereinafter collectively and individually a "milled" or "grooved" receiver). The male dovetail is typically ⅜" wide as is standard in the industry. Of course, other suitable sizes of the dovetail receiver are contemplated and are believed to exist, however, the ⅜" male dovetail is the most common.

Given a milled or grooved receiver having a standard ⅜" dovetail, the shooter must incorporate the ⅜" dovetail cooperating female dovetail scope rings in order to attach a scope to such a receiver. That is, scope rings having a ⅜" dovetail female connection portion must be used in order to secure a scope to a ⅜" or other suitably configured dovetail receiver. Given that many shooters require the use of high-powered rifle scopes on small caliber firearms such as the 22, it becomes a problem where the shooter relies on one or a small number of rifle scopes in which to use.

In this manner, if the shooter uses a standard Weaver style scope ring and base on a high-powered rifle, or any other firearm for that matter, and wishes to use the same scope on a ⅜" or other suitably grooved receiver on yet another firearm, an incompatibility problem exists. The incompatibility is attributable to the Weaver style rings associated with a Weaver style base for a high-powered rifle and thus the limitation with respect to their compatibility on a small caliber firearm with a ⅜" or other suitably grooved receiver.

A standard Weaver style scope ring mounting system will not fit a ⅜ grooved receiver. Thus, the shooter must typically remove the entire ring assembly from the scope, replace the rings with a ⅜" female dovetail set of rings, commonly referred to as "tipoff" style rings in order to use the same shooting scope with a ⅜" grooved receiver. Associated with this problem is the difficulty associated with aligning the reticles of the shooting scope in a proper orientation when the rings are tightened about the scope. In this manner, the vertical crosshair is preferably perpendicular to the plane of the receiver of the firearm and the horizontal crosshair is parallel. When the shooter positions the scope in a particular set of rings and tightens the rings, the scope does not move and maintains its proper alignment and orientation while firing.

Accordingly, if the shooter were to remove the scope from the ring system, attach new rings and mount those rings to a ⅜" grooved receiver, he must then realign the reticles of the scope with respect to the rings as well as adjust the eye relief distance of the scope and zero it before use.

Eye relief relates to the distance scope objective, the end the shooter peers through initially to view the target through the scope, from the shooter's eye. In addition, the incompatibility problem between Weaver style bases, which are very popular in the shooting sports, raises significant problems for shooters who wish to use the same scope on their high-powered shooting equipment and their small caliber shooting equipment such as 22 rimfire.

Until now, a scope mounting system capable of being used on a ⅜" or other suitably grooved small caliber firearm receiver, but accepting a standard Weaver style high-powered mount typically associated with larger caliber firearms and the associated Weaver style bases, has not been invented.

SUMMARY OF THE INVENTION

An embodiment of the present invention consists of a base component configured with a female dovetail suitable for attachment to a ⅜" or other suitably grooved receiver of a small caliber firearm. Of course, other firearms with such receivers are believed to exist and the same structure may also be used for such other firearms. The base portion of the tipoff mount, therefore, is attached to the grooved receiver. An adapter bracket is positioned over the dovetail tipoff base portions. The adapter is substantially rectangular in shape and has a central cutout as well as spaced apart pairs of flanges protruding from the sides of the adapter. The flanges include bores extending through the distal end of the flanges.

In use, the adapter plate is positioned above the dovetail bases secured to the grooved receiver and fasteners are inserted through the bores to engage the bores of the bases typically provided to receive a fastener associated with the uppermost portion of the scope ring. That is, rather than using the conventional uppermost portion of the scope ring to clamp the scope tube between the base and the top of the scope ring, the adapter plate is positioned over the base and fasteners are inserted through the bores to engage the bores typically reserved for fasteners to clamp the upper portion of the scope ring to the base. In this manner, the adapter then spans the two bases to insure a proper rigid alignment.

The elongated aperture of the base plate is provided such that when a Weaver style base is placed upon the adapter plate, given that a Weaver style base has at least one usually a pair of axially aligned screw bores, the screw bores line up with the aperture of the plate. In this fashion, a supplemental clamping plate is placed against the bottom surface of the adapter plate and mounting screws are inserted through the bores of the Weaver style base. The fasteners are inserted through the bores of the Weaver style base then the head of the fasteners are captured by the Weaver style base and the shank protrudes through the base through the aperture of the adapter plate and through the clamping plate. A nut may be used to secure the other end of the fastener thereby sandwiching the Weaver style base to the adapter plate which as described above has already been attached to a dovetail base suitably configured to engage a ⅜" dovetail or other suitably configured grooved receiver.

In the alternative, the clamping plates positioned beneath the adapter plate may be threaded to correspond with the thread pattern of the screws used to secure the Weaver style base to the adapter plate. In this manner, the nut is no longer needed because the cooperating contact between the screws and the clamping plate is sufficient to hold the weave style base to the adapter plate.

In this manner, once the combination has been fully assembled and secured to a ⅜" or other suitably grooved receiver of a firearm, the shooter may simply attach a scope having Weaver style scope rings directly to the assembled combination on the receiver. In this manner, the shooter may simply remove a scope from any firearm configured with a Weaver style base, leave the scope rings securely attached to the scope tube ensuring the proper alignment of the reticles as described above, and merely tighten the scope rings to the Weaver style bases already fitted to the adapter plate as it is secured to the grooved ⅜" or other suitably grooved receiver. Thus, swapping scopes from one firearm to another is an easy task.

An alternate embodiment of the present invention provides a ⅜" scope, ⅜" grooved receiver, and female dovetail scope base of the tipoff style with a Weaver style stem protruding above the dovetail base. The unit is preferably constructed of a single piece of material to insure integrity, but multiple components are contemplated so long as the Weaver style base can be secured to the dovetail base. In this manner, once the base is attached to the grooved receiver, the shooter may simply remove a scope having Weaver style scope rings and attach it to the grooved receiver which, prior to the reduction to practice of the invention, was believed to be impossible due to the incompatibility of the sizes and configurations of the scope bases.

The present invention may be summarized in a variety of ways, one of which is the following: a universal scope mounting system, comprising: scope base means configured to engage a grooved receiver of a firearm; the base means further includes a Weaver style top portion configured to receive a Weaver style scope ring.

The invention may also be summarized as follows: a universal scope mounting system, comprising: a base having a dovetail attachment portion configured to attach to a dovetail receiver of a firearm; and plate means configured to receive a Weaver style top portion and scope ring system wherein the plate means further includes a Weaver style base component.

The mounting system may further include an adapter plate interpositioned between the scope base means and the Weaver style top portion, and a clamping plate provided to secure the Weaver style top portion to the adapter plate. The base means and Weaver style top portion may merge to form a unitary whole.

The mounting system preferably includes dovetail means for attaching the base means to a grooved receiver of a firearm. Fasteners are provided to attach the base means to the adapter plate, and attach the clamping plate to the Weaver style top portion. The invention may also be used in conjunction with a ring system for attaching a scope tube to the Weaver style top portion.

It is an object of the present invention to provide a scope mounting system capable of being used in association with a tipoff mount style grooved receiver yet capable of receiving a scope fitted with Weaver style rings.

It is an object of the present invention to provide a scope mounting system enabling the shooter to move a scope from one firearm to another without respect to the style of the receiver or orientation of the receiver as it relates to the type of base.

It is an object of the present invention to provide an apparatus to enable a shooter to remove a scope from a firearm having Weaver style rings and bases and attach it to a firearm with a ⅜" grooved receiver or other suitably configured grooved receiver.

It is an object of the present invention to provide a scope mounting system capable to attaching to a ⅜" or other suitably grooved receiver without the need of removing the Weaver style rings attached to the scope.

It is an object of the present invention to provide an adjustable scope mounting system capable of receiving a scope having Weaver style rings and avoid the incompatibility problems associated with Weaver style rings and dovetail receivers.

These and other objects, features and advantages shall become apparent after consideration of the specification and drawings. All such objects, features and advantages are believed to be part of the present invention even though not specifically set forth herein.

DETAILED DESCRIPTION OF THE PREFERRED EMBODIMENT(S)

Figure 1:
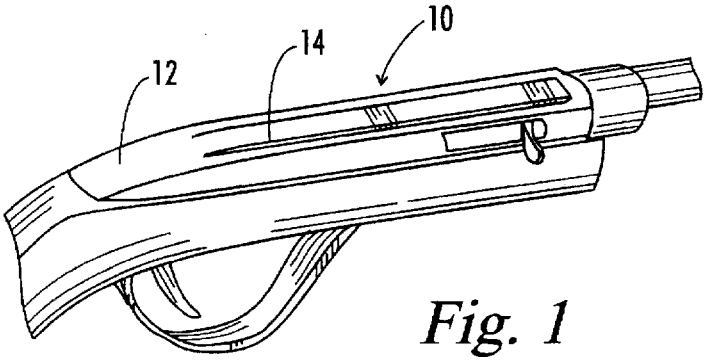
FIG. 1 is an elevated perspective view of a firearm with a standard dovetail grooved receiver.

With reference to FIG. 1, a firearm designated generally by the reference numeral 10 includes a receiver 12 having a dovetail male component 14. The dovetail component 14 is typically a ⅜" dovetail or other suitably configured dovetail commonly associated with firearms. Such dovetails are more readily associated with the grooved receivers of small caliber firearms such as 22 rimfire dries.

Figure 2:
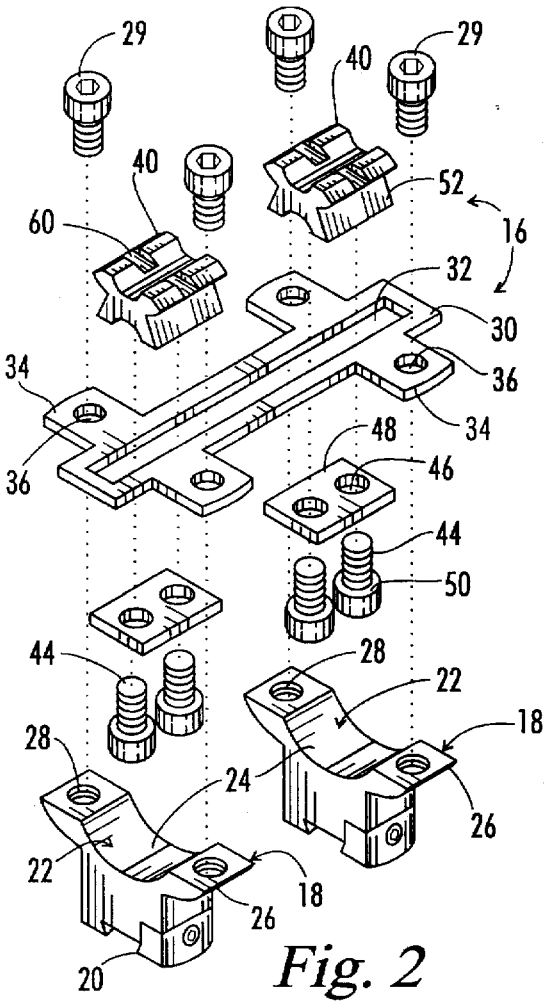
FIG. 2 is an elevated exploded view of the components of an embodiment of the adapter system of the present invention.
Figure 3:
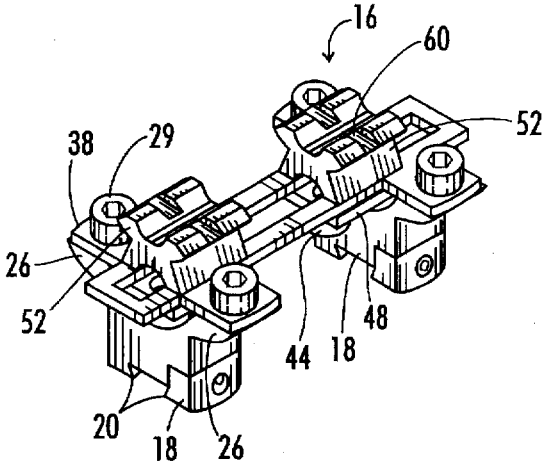
FIG. 3 is a side view of the assembled adapter system configured to be attached to a grooved receiver of a firearm of the type shown in FIG. 1, and receive Weaver style scope rings.
Figure 4:
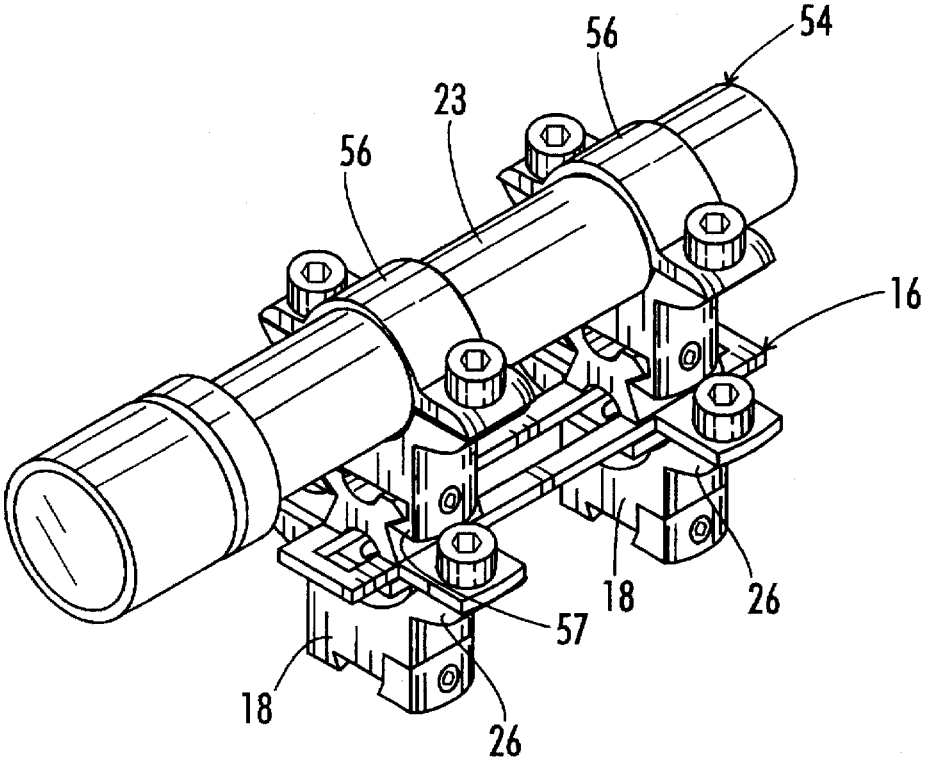
FIG. 4 is a side view of the embodiment of the present invention shown in FIG. 3 with a shooting scope attached by virtue of the Weaver style base and rings.

With reference to FIGS. 2–4, an embodiment of the present invention is designated generally in its collective component form by the reference numeral 16. Embodiment 16 includes a pair of dovetail bases 18 configured with a female dovetail suitably sized to cooperate with the dovetail 14 of the receiver 12 shown on the firearm 10 of FIG. 1. Dovetail bases 18 therefore include a dovetail portion 20 and a scope cradle 22. Scope cradle 22 typically receives a scope tube 23 within the saddle portion 24. Ears 26 have an axially aligned bore 28 capable of receiving a fastener 29. Adapter plate 30 is generally rectangular and has a central aperture 32 as well as pairs of spaced apart flanges 34. The flanges further include bores 36 configured to enable the fastener 29 to be inserted therethrough. With reference to FIGS. 3 and 4, adapter plate 30 is positioned atop base 18 and secured thereto by fasteners 29. Fasteners 29 engage the bores 28 of the ears 26 of the base 18.

Weaver style base 40 is also provided as a complement of an embodiment of the present invention. Weaver style base 40 includes at least one, but shown as a pair, of axially aligned screw bores (not shown). The screw bores are provided to receive fasteners 44. As shown in FIG. 3, when the Weaver style base 40 is positioned on the adapter plate 30, fasteners 44 are inserted through the bores 46 of a clamping plate 48 and into the bores (not shown) of the Weaver style base. In this manner, when the fasteners are tightened, the base is securely attached to the adapter plate 30. Of course, the fasteners 44 may be inserted through the top surface of the Weaver style base so long as the head 50 of the fastener 44 lies sufficiently below the rails 52 of the Weaver style base 40 in order that a scope 54 fitted with Weaver style rings 56 with a Weaver attachment member 57 may be positioned on the Weaver style base 40 and the fasteners 44 attaching the clamping plate 48 lie within the groove 60 of the Weaver style base.

Figure 5:
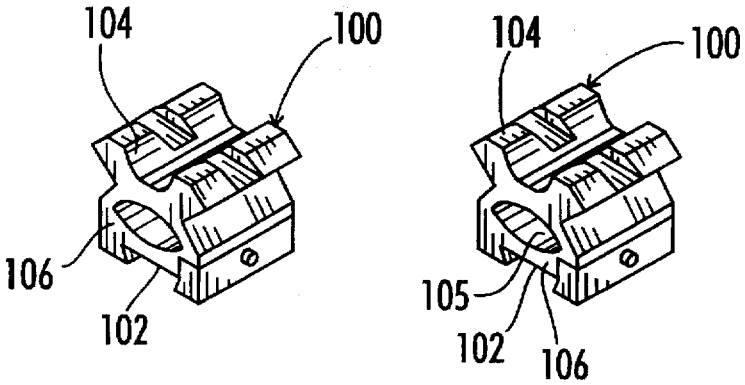
FIG. 5 is an elevated perspective view of an alternate embodiment of the base portion of the adapter system of the present invention

An alternate embodiment of the present invention is designated generally by the reference numeral 100 in, FIG. 5. The adapter base 100 has a dovetail component 102 configured to engage the dovetail groove 14 of the receiver 12 shown on the firearm 10 of FIG. 1. A Weaver style top portion 104 is attached to the base portion 106 which includes an opening 105 of substantially elliptical configuration for viewing a target without the use of the telescope, by any form of rigid communication such as forming the entire structure of a single piece of material, an adhesive, or other suitable means to rigidly secure a top portion 104 to a bottom portion 106 and form and integral connection therebetween. In this manner, the base 100 may be simply attached to the groove 14 of the receiver 12 on the firearm 10 as shown in FIG. 1 and receive a scope 54 having Weaver style rings 56 as shown in FIG. 4.

These and other embodiments and equivalents of the present invention shall become apparent after consideration of the scope of the specification and drawings. All such embodiments and equivalents are believed to be part of the present invention whose only limitation is the scope of the appended claims.

What is claimed is:

1. An adapter base in combination with a telescope with attachment rings and a firearm having a receiver comprising:

said adapter base including a lower female dovetail groove that attaches to a male dovetail component of the receiver and an upper Weaver attachment member that attaches to a corresponding Weaver attachment member of said attachment rings;

said adapter base having a base portion intermediate the lower female dovetail groove and the upper Weaver attachment member, said base portion including an opening of substantially elliptical configuration with the elliptical configuration having its transverse axis extending across more than half of the width of the adapter base;

wherein said opening aids in viewing a target without the use of the telescope.

* * * * *